US009974154B2

(12) United States Patent
Ito et al.

(10) Patent No.: US 9,974,154 B2
(45) Date of Patent: May 15, 2018

(54) POWER SUPPLY DEVICE AND METHOD FOR PLASMA GENERATION

(71) Applicant: Hitachi Kokusai Electric Inc., Tokyo (JP)

(72) Inventors: Taizo Ito, Tokyo (JP); Manabu Nakamura, Tokyo (JP)

(73) Assignee: HITACHI KOKUSAI ELECTRIC INC., Tokyo (JP)

( * ) Notice: Subject to any disclaimer, the term of this patent is extended or adjusted under 35 U.S.C. 154(b) by 110 days.

(21) Appl. No.: 15/053,227

(22) Filed: Feb. 25, 2016

(65) Prior Publication Data

US 2016/0174354 A1 Jun. 16, 2016

Related U.S. Application Data

(63) Continuation of application No. PCT/JP2014/072133, filed on Aug. 25, 2014.

(30) Foreign Application Priority Data

Aug. 26, 2013 (JP) ..... 2013-174891

(51) Int. Cl.
*H05H 1/46* (2006.01)

(52) U.S. Cl.
CPC ..... *H05H 1/46* (2013.01); *H05H 2001/4682* (2013.01)

(58) Field of Classification Search
USPC ..... 315/111.21–111.51
See application file for complete search history.

(56) References Cited

U.S. PATENT DOCUMENTS 6,313,584 B1 * 11/2001 Johnson ..... H01J 37/32082 315/111.21
9,325,282 B2 * 4/2016 Bowers ..... H03F 3/195
(Continued)

FOREIGN PATENT DOCUMENTS

JP 2002-270574 A 9/2002
JP 2006-260857 A 9/2006
(Continued)

OTHER PUBLICATIONS

Japanese Office Action dated Nov. 2, 2016, issued in corresponding Japanese Patent Application No. 2015-191270 and English translation thereof.
(Continued)

*Primary Examiner* — Douglas W Owens
*Assistant Examiner* — Srinivas Sathiraju
(74) *Attorney, Agent, or Firm* — Bacon & Thomas, PLLC

(57) ABSTRACT

A power supply device includes: an oscillation unit for outputting a high frequency signal; a modulation unit for outputting a pulsed high frequency signal; a level adjustment unit for adjusting and outputting a level of the pulsed high frequency signal; a power amplifier for amplifying a power outputted from the level adjustment unit; an output power detection unit for detecting an output power value from the power amplifier; and a control unit. The control unit corrects and outputs a level control signal for controlling the level of the pulsed high frequency signal based on a corresponding correction factor at each of elapsed times in an on state of the pulsed high frequency signal, and compares comparison values in a current pulse and a previous pulse to update the correction factor such that comparison result between the set power value and the output power value becomes smaller at each reflection coefficient.

9 Claims, 9 Drawing Sheets

(56) References Cited

U.S. PATENT DOCUMENTS

| | | | | |
|---|---|---|---|---|
| 9,451,687 | B2 * | 9/2016 | Yuzurihara | H05H 1/46 |
| 9,578,731 | B2 * | 2/2017 | Van Zyl | H05H 1/46 |
| 2011/0032047 | A1 * | 2/2011 | Yuzurihara | H01J 37/32082 332/108 |
| 2011/0121735 | A1 * | 5/2011 | Penny | A61B 18/042 315/111.21 |
| 2015/0040828 | A1 | 2/2015 | Morisawa et al. | |

FOREIGN PATENT DOCUMENTS

| | | | |
|---|---|---|---|
| JP | 2010-141000 | A | 6/2010 |
| JP | 2015-035530 | A | 2/2015 |
| WO | 2011/016266 | A1 | 2/2011 |

OTHER PUBLICATIONS

International Search Report dated Oct. 7, 2014.

* cited by examiner

POWER SUPPLY DEVICE AND METHOD FOR PLASMA GENERATION

CROSS-REFERENCE TO RELATED APPLICATION

This application is a Continuation Application of PCT International Application No. PCT/JP2014/072133 filed on Aug. 25, 2014, which designated the United States. This application claims priority to Japanese Patent Application No. 2013-174891 filed on Aug. 26, 2013, the entire contents of which are incorporated herein by reference.

FIELD OF THE INVENTION

The present invention relates to a power supply device and method for plasma generation that is a high frequency power supply device and method used for generating plasma.

BACKGROUND OF THE INVENTION

A plasma etching apparatus is used in, e.g., a manufacturing process of a semiconductor device such as IC (integrated circuit), LSI (large-scale integration) and the like. In such a plasma apparatus, there is employed a power supply device for plasma generation that is a high frequency power supply device used for generating plasma. A conventional high frequency power supply device will be described with reference to FIGS. 1 and 5. FIG. 1 is a block diagram showing a functional configuration of a high frequency power supply device in accordance with an embodiment of the present invention, but it is identical to the conventional high frequency power supply device except for a function of a control unit. FIG. 5 is a schematic view showing signal waveforms of the conventional high frequency power supply device.

As shown in FIG. 1, the conventional high frequency power supply device includes an oscillation unit 11, a modulation unit 12, a level adjustment unit 13, a power amplifier 14, an output power detection unit 15 and a control unit 16. The level adjustment unit 13 includes a level adjustment circuit 13*a* and a D/A (digital-to-analog) converter 13*b*. The output power detection unit 15 includes a directional coupler 15*a*, a detector 15*b* and an A/D (analog-to-digital) converter 15*c*.

As shown in FIG. 1, a RF (radio frequency) signal 11*s* that is a high frequency signal sent from the oscillation unit 11 is pulse-modulated by the modulation unit 12. A power level of the pulse-modulated signal is adjusted by the level adjustment unit 13 and the level-adjusted signal is inputted to the power amplifier 14. An output of the power amplifier 14 is outputted to a plasma load 20 through the output power detection unit 15.

In the output power detection unit 15, the detector 15*b* detects an output power Pf of the power amplifier 14 extracted by the directional coupler 15*a*, and the A/D converter 15*c* converts the detected power into a digital signal and outputs the digital signal to the control unit 16.

The control unit 16 obtains a difference between the output power detected by the output power detection unit 15 (i.e., the digital signal from the A/D converter 15*c*) and a set power that is previously set, and controls a level adjustment value to be outputted to the level adjustment unit 13 such that the difference becomes zero. The control unit 16 outputs a level control signal 16*s*2 to the level adjustment unit 13. The D/A converter 13*b* converts the level control signal 16*s*2 into an analog signal and outputs the analog signal as the level adjustment signal 13*bs* to the level adjustment circuit 13*a*.

As such, the control unit 16 controls the output power of the high frequency power supply device to become a constant value by controlling the level adjustment circuit 13*a*. The level adjustment circuit 13*a* adjusts the output power by using a circuit of a variable attenuator or the like.

FIG. 5 shows time waveforms of the respective units. In FIG. 5, (a) depicts a waveform of the output power Pf, (b) depicts a waveform of the modulation signal 16*s*1, and (c) depicts a waveform of the level adjustment signal 13*bs*. The output power Pf is a high frequency signal and an envelope curve of the high frequency signal is shown in FIG. 5. As such, the waveform of the output power Pf is formed by pulse-modulating the RF signal 11*s* from the oscillation unit 11 by using the modulation signal 16*s*1.

A method of adjusting a level of the output power in the conventional high frequency power supply device will be described. First, a conventional output power level adjusting method will be briefly described. The control unit 16 detects the high frequency output power Pf through the output power detection unit 15 from a time point at which the modulation signal 16*s*1 is turned on. Marks ○ shown in FIG. 5 are detection points of the output power Pf. Next, the control unit 16 compares an average value of the detected output power Pf with a set power, and calculates a level adjustment value such that the difference between the average value and the set power falls within a predetermined range. A value of the level adjustment signal 13*bs* is changed and outputted at a timing at which the modulation signal 16*s*1 is turned off. The changed value is reflected in a subsequent pulse output. In such a high frequency power supply device that outputs a pulse-modulated high frequency power, it is general to perform, between pulses, a control of an output power level because there may be a case where a pulse width is as short as several μs.

The conventional output power level adjusting method will be described in detail with reference to a flow chart of FIG. 6. FIG. 6 is a flow chart showing the conventional output power level adjusting method. The adjustment of an output power level is controlled by the control unit 16. First, a set power and an allowable power range are set in an initial setting in step S101. The allowable power range is an allowable difference value between the output power Pf and the set power.

Next, the high frequency power supply device is operated and it is examined whether or not the modulation signal 16*s*1 has been turned on, i.e., whether or not the output power Pf has been outputted in step S102. If the modulation signal 16*s*1 is not in an on state (NO in step S102), the device waits until the modulation signal 16*s*1 is turned on. If the modulation signal 16*s*1 is turned on (YES in step S102), a value of the output power Pf (e.g., Pf1) at that moment is obtained in step S103. Thereafter, it is examined whether or not the modulation signal 16*s*1 has been turned off, i.e., whether or not the output power Pf has been turned off in step S104. If the modulation signal 16*s*1 is not in an off state (NO in step S104), the flow goes to step S103, and a value of the output power Pf (e.g., Pf2) at that moment is obtained.

If the modulation signal 16*s*1 is turned off (YES in step S104), an average value of the obtained output power Pf (Pf1, Pf2, . . . ) is calculated in step S105, and the average value of the output power Pf and the set power are compared to each other in step S106.

If a difference between the average value of the output power Pf and the set power is within the allowable power range (YES in step S107), the flow returns to step S102. If the difference between the average value of the output power Pf and the set power is not within the allowable power range (NO in step S107), a level adjustment value N is calculated based on the difference between the average value of the output power Pf and the set power in step S108. For example, if the average value of the output power Pf is larger than the set power while exceeding the allowable power range, the level adjustment value N is calculated to decrease, and if the average value of the output power Pf is smaller than the set power while exceeding the allowable power range, the level adjustment value N is calculated to increase.

Next, the level adjustment value N is updated in step S109, and the flow returns to step S102. By updating the level adjustment value N, a magnitude of the level adjustment signal 13*bs* outputted to the level adjustment circuit 13*a* is updated.

In Japanese Patent Application Publication No. 2002-270574, there is disclosed a plasma etching apparatus that applies a pulsed high frequency power to a vacuum chamber in which a plasma etching is performed on a wafer.

As described above, in the conventional output power level adjusting method, a level adjustment value is set such that a difference between an average value of the detected output power Pf and the set power falls within a predetermined range in an off state between modulation pulses. By doing so, an average output power of a subsequent modulation pulse is controlled. However, impedance of a plasma load is not always constant and changed depending on an operation state of the plasma load even during an on-state of the modulation pulse. If the impedance of the plasma load is changed, the characteristic of the power amplifier 14 is changed and a value of the output power Pf is separated away from a value of the set power.

That is, as shown in FIG. 5, when the modulation signal 16*s*1 is turned on and the power Pf is supplied to the plasma load, the plasma load starts to operate. However, after the operation of the plasma load, the state of the plasma load is not constant and impedance of the plasma load is changed. For this reason, when controlling only an average output power as in the conventional way, the output power Pf is changed in an on-state of the modulation pulse, so that a value of the output power Pf is separated away from the set power value. The object of the present invention is to provide a power supply device for plasma generation which can prevent a value of the output power from being separated away from the set power value by suppressing fluctuations of the output power in an on-state of the modulation pulse.

SUMMARY OF THE INVENTION

A representative configuration of a power supply device for plasma generation in accordance with the present invention for solving the above problems is as follows. That is, there is provided a power supply device for plasma generation using a pulse modulation system which supplies a pulsed high frequency power to a plasma generation unit for generating plasma provided outside, the power supply device including: an oscillation unit configured to output a high frequency signal of a predetermined frequency; a modulation unit configured to modulate the high frequency signal outputted from the oscillation unit to a pulse shape in which on and off states are repeated and output the modulated high frequency signal as a pulsed high frequency signal; a level adjustment unit configured to adjust a level of the pulsed high frequency signal outputted from the modulation unit and output the level-adjusted pulsed high frequency signal; a power amplifier configured to amplify a power of the pulsed high frequency signal outputted from the level adjustment unit and output a pulsed high frequency power; an output power detection unit configured to detects an output power value of the pulsed high frequency power outputted from the power amplifier; a storage unit that stores a plurality of elapsed times in an on-state of the pulsed high frequency signal outputted from the modulation unit, a plurality of correction factors respectively corresponding to the elapsed times, and a set power value that is previously set as a value of an output power; and a control unit configured to receive the output power value detected by the output power detection unit, and output to the level adjustment unit a level control signal for controlling the level of the pulsed high frequency signal adjusted in the level adjustment unit based on the received output power value and the set power value, wherein the control unit corrects and outputs the level control signal at each of the elapsed times based on the correction factors respectively corresponding to the elapsed times, and compares a comparison value in a current pulse with a comparison value in a previous pulse to update the correction factors such that a comparison result between the set power value and the output power value becomes smaller at each reflection coefficient Γ.

Further, there is provided a power supply method for plasma generation using a pulse modulation system which supplies a pulsed high frequency power to a plasma generation unit for generating plasma provided outside, the power supply method including: outputting a high frequency signal of a predetermined frequency; modulating the outputted high frequency signal to a pulse shape in which on and off states are repeated and outputting the modulated high frequency signal as a pulsed high frequency signal; adjusting a level of the pulsed high frequency signal and outputting the level-adjusted pulsed high frequency signal; amplifying a power of the pulsed high frequency signal and outputting a pulsed high frequency power; detecting an output power value of the pulsed high frequency power; and allowing a control unit to receive the detected output power value and output to a level adjustment unit a level control signal for controlling the level of the pulsed high frequency signal adjusted in the level adjustment unit based on the received output power value and a set power value that is previously set as a value of an output power. The control unit corrects and outputs the level control signal at each of a plurality of elapsed times in an on-state of the pulsed high frequency based on correction factors respectively corresponding to the elapsed times, and compares a comparison value in a current pulse with a comparison value in a previous pulse to update the correction factors such that a comparison result between the set power value and the output power value becomes smaller at each reflection coefficient.

Effect of the Invention

In accordance with the above configuration, it is possible to prevent a value of the output power from being separated away from the set power value by suppressing fluctuations of the output power in an on-state of the modulation pulse.

DETAILED DESCRIPTION OF THE EMBODIMENTS

First Embodiment

The present inventors have found that after supplying power to a plasma load 20 by turning on a pulsed modulation signal 16*s*1, an output power value varies with the lapse of time, and the fluctuations of the output power value are repeated in the same pattern when the plasma load 20 has the same property. For example, the fluctuation pattern of the output power value is identical in the same plasma generating apparatuses. In a first embodiment, the present inventors have paid attention to a phenomenon in which the output power varies in the same pattern as time goes by after the pulsed modulation signal 16*s*1 is turned on. In the first embodiment, an output power within an on-period of the modulation signal 16*s*1 is controlled to become a constant value by correcting a level adjustment signal 13*bs* in each elapsed time.

Figure 1:
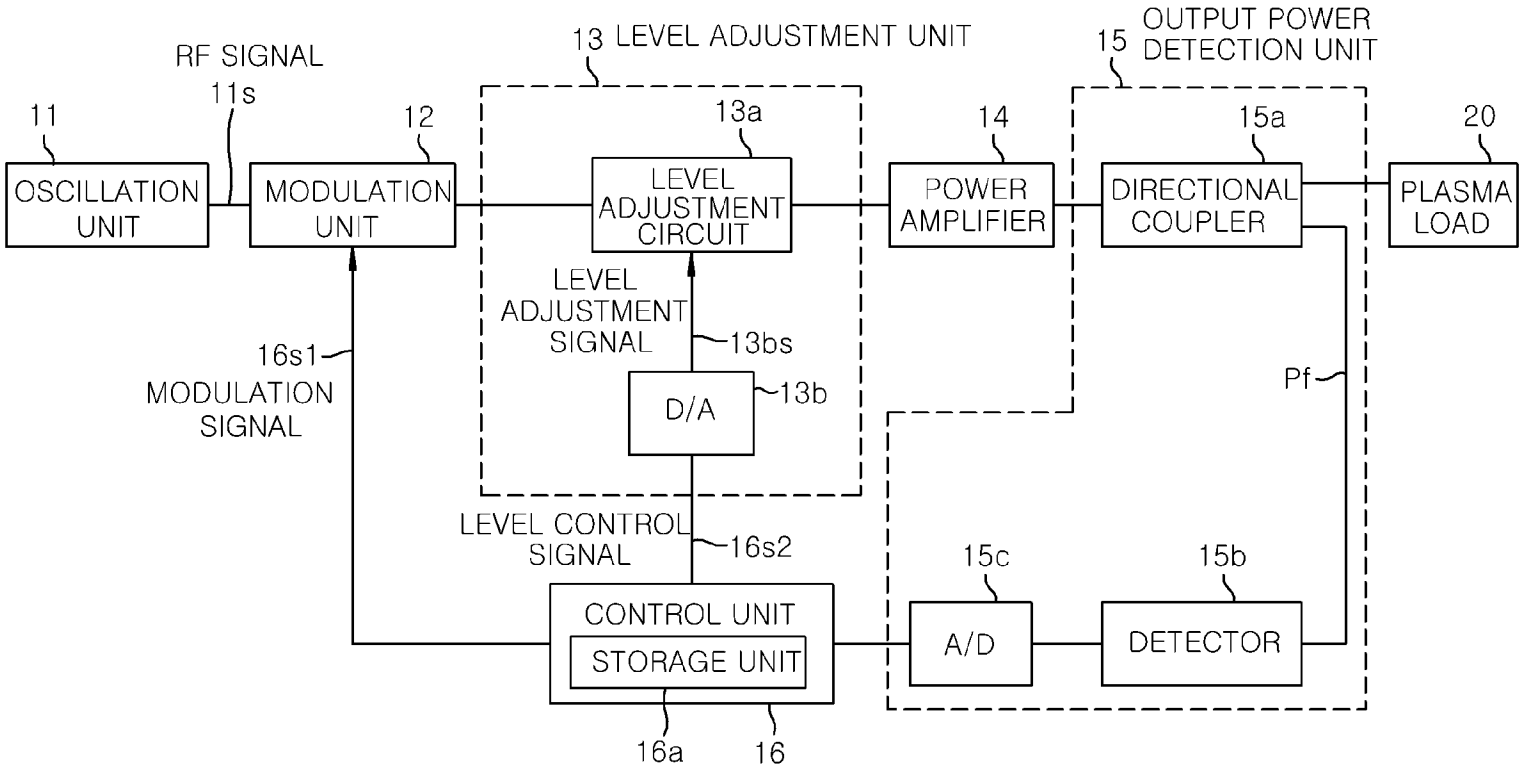
FIG. 1 is a block diagram showing a functional configuration of a high frequency power supply device in accordance with a first embodiment of the present invention.
Figure 2:
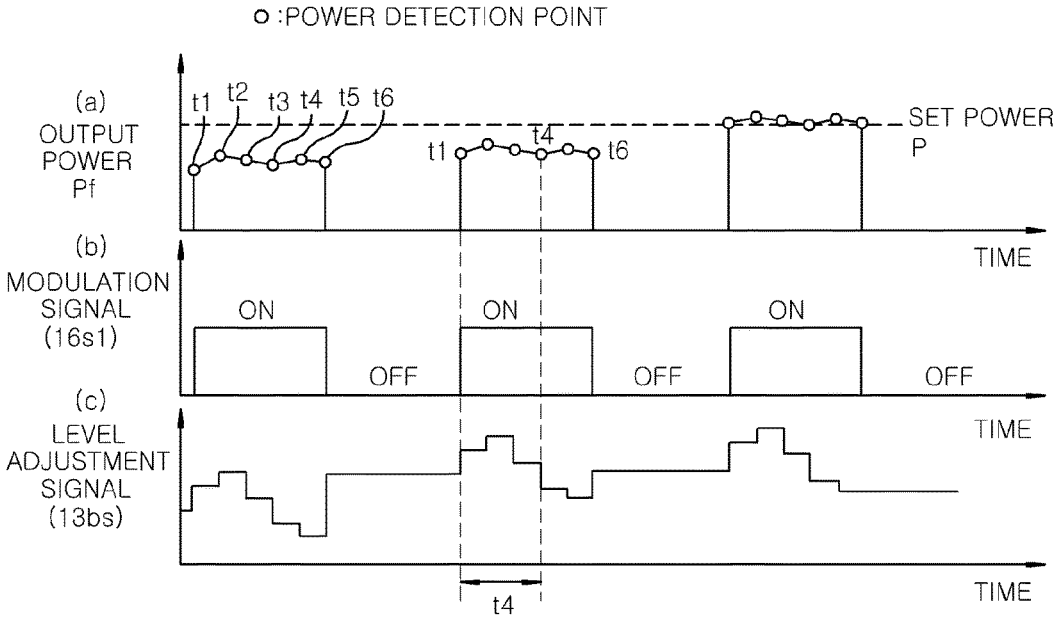
FIG. 2 is a schematic view showing signal waves of the high frequency power supply device in accordance with the first embodiment of the present invention.
Figure 3:
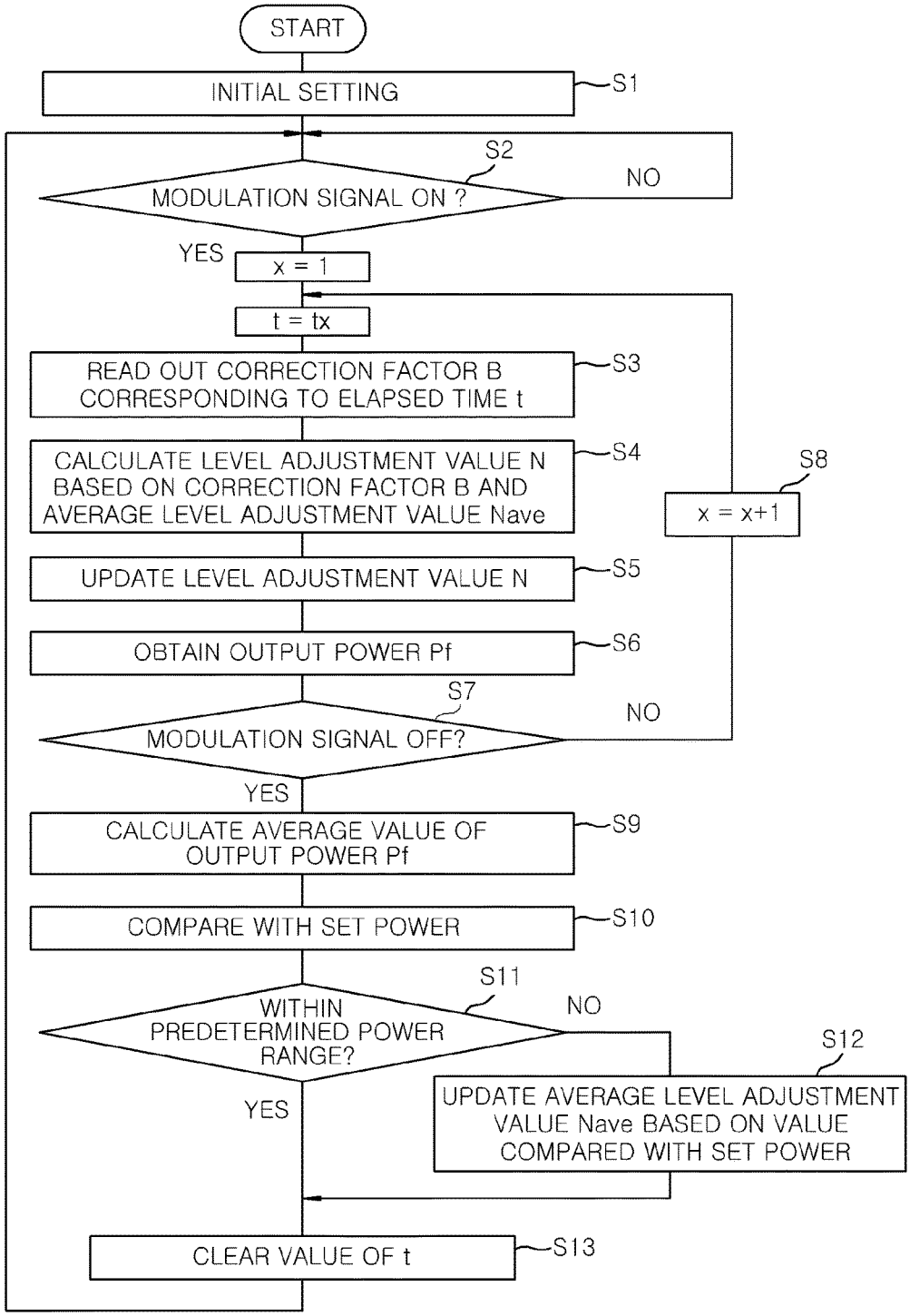
FIG. 3 is a flow chart showing an output power level adjusting method in accordance with the first embodiment of the present invention.

The first embodiment of the present invention will be described with reference to FIGS. 1 to 3. FIG. 1 is a block diagram showing a functional configuration of a high frequency power supply device in accordance with the first embodiment of the present invention. FIG. 2 is a schematic view showing signal waves of the high frequency power supply device in accordance with the first embodiment of the present invention. FIG. 3 is a flow chart showing a method of adjusting an output power level in accordance with the first embodiment of the present invention.

As shown in FIG. 1, the high frequency power supply device of the first embodiment includes an oscillation unit 11, a modulation unit 12, a level adjustment unit 13, a power amplifier 14, an output power detection unit 15 and a control unit 16. The high frequency power supply device is a power supply device for plasma generation using a pulse modulation system which supplies a pulsed high frequency power to the plasma load 20 serving as a plasma generation unit for generating plasma. The level adjustment unit 13 includes a level adjustment circuit 13*a* and a D/A (digital-to-analog) converter 13*b*. The output power detection unit 15 includes a directional coupler 15*a*, a detector 15*b* and an A/D (analog-to-digital) converter 15*c*. The control unit 16 includes a storage unit 16*a*. As stated above, the control unit 16 is only different from that of the conventional high frequency power supply device. Other configurations than the control unit 16 are identical to those of the conventional high frequency power supply device.

The oscillation unit 11 outputs a high frequency signal (RF signal) 11*s* of a predetermined frequency, e.g., about 30 MHz. The modulation unit 12 modulates the RF signal 11*s* outputted from the oscillation unit 11 to a pulse shape in which on and off states are repeated, by using the pulsed modulation signal 16*s*1 outputted from the control unit 16. The modulated RF signal is outputted as a pulsed high frequency signal. The on-state indicates a state where the high frequency signal is being outputted, and the off-state indicates a state where the high frequency signal is not outputted. In other words, the modulation unit 12 outputs the RF signal only during an on-period of the pulsed modulation signal 16*s*1 shown in FIG. 2. The pulse-on period of the modulation signal 16*s*1 is, e.g., about 1 ms, and the pulse-off period of the modulation signal 16*s*1 is, e.g., about 1 ms.

The level adjustment unit 13 includes a variable attenuator and the like. The level adjustment unit 13 adjusts a level (amplitude) of the pulsed high frequency signal outputted from the modulation unit 12 based on a level control signal 16*s*2 outputted from the control unit 16 and outputs the level-adjusted signal. Specifically, the D/A converter 13*b* of the level adjustment unit 13 converts a digital signal (the level control signal 16*s*2) outputted from the control unit 16 into an analog signal (the level adjustment signal 13*bs*) and outputs the analog signal to the level adjustment circuit 13*a*. The D/A converter 13*b* may be provided in the control unit 16 as a part of the control unit 16.

The power amplifier 14 amplifies a power of the pulsed high frequency signal outputted from the level adjustment unit 13 by a predetermined amplification degree and outputs a pulsed high frequency power. The output power detection unit 15 extracts the pulsed high frequency power outputted from the power amplifier 14 and outputs the same to the plasma load 20. Further, the output power detection unit 15 detects the pulsed high frequency power outputted from the power amplifier 14 and outputs the same to the control unit 16. The plasma load 20 is a plasma generating apparatus, such as a plasma etching apparatus or the like, which generates plasma. Specifically, the directional coupler 15*a* of the output power detection unit 15 extracts the output from the power amplifier 14, and the detector 15*b* detects a level of the extracted output power Pf. The A/D converter 15*c* converts the analog output signal from the detector 15*b* into a digital signal and outputs the digital signal to the control unit 16. The A/D converter 15*c* may be provided in the control unit 16 as a part of the control unit 16.

The control unit 16 includes, as hardware components, a CPU (central processing unit) and the storage unit 16*a* that stores operation programs of the CPU. In the storage unit 16*a*, there are previously stored a set power value Ps that is set as a target power value desired to be outputted, a plurality of elapsed times t in an on-state of the pulsed high frequency signal outputted from the modulation unit 12, a plurality of correction factors B respectively corresponding to the elapsed times t, and an average level adjustment value Nave. The correction factors B are stored in association with the corresponding elapsed times t. The average level adjustment value Nave will be described later. The set power value Ps, the average level adjustment value Nave, the elapsed times t and the correction factors B are previously inputted through an operation unit (not shown) of the high frequency power supply device by an operator and stored in the storage unit 16*a*.

The control unit 16 receives an output power value detected by the output power detection unit, and calculates a level adjustment value for the level adjustment unit 13 based on the received output power value and the set power value Ps. Further, the control unit 16 creates the level control signal 16*s*2 based on the level adjustment value and outputs the created signal to the level adjustment unit 13. The level control signal 16*s*2 controls a level of the pulsed high frequency signal adjusted in the level adjustment unit 13. Furthermore, at each of the elapsed times t, the control unit 16 corrects and outputs the level adjustment value, i.e., the level control signal 16*s*2 based on the correction factors B respectively corresponding to the elapsed times t. As such, the control unit 16 controls the output power of the high frequency power supply device to become a constant value in a pulse-on state by correcting the level adjustment value, i.e., the level control signal 16*s*2 outputted to the level adjustment unit 13 based on the correction factors B.

FIG. 2 shows time waveforms of the respective units. In FIG. 2, (a) depicts a waveform of the output power Pf, (b) depicts a waveform of the modulation signal 16*s*1, and (c) depicts a waveform of the level adjustment signal 13*bs*. Marks "○" shown in FIG. 2 are detection points of the output power Pf and indicates elapsed times t1 to t6 from a time point at which the modulation signal 16*s*1 is turned on. For example, the mark "○" at t4 indicates an elapsed time t4 from the time point at which the modulation signal 16*s*1 is turned on. The output power Pf is a high frequency signal and an envelope curve of the high frequency signal is shown in FIG. 2. As such, the waveform of the output power Pf is formed by pulse-modulating the high frequency signal 11*s* from the oscillation unit 11 by using the modulation signal 16*s*1.

An operation of the control unit 16 will be described in detail. As stated above, in the storage unit 16*a*, there are previously stored the elapsed times t (t1, t2, . . . , tn) after the modulation signal 16*s*1 is turned on, the correction factors B (B1, B2, . . . , Bn) respectively corresponding to the elapsed times t, and the average level adjustment value Nave. The correction factors B1 to Bn respectively correspond to the elapsed times t1 to tn, and are factors for correcting a value of the output power Pf which varies depending on the elapsed time t after the modulation signal 16*s*1 is turned on. Here, n is a natural number equal to or larger than 2. In an example of FIG. 2, n is 6.

The average level adjustment value Nave is a variable for adjusting a level of the output power to an appropriate value, and is maintained at a constant value between pulse-on states of the modulation signal 16*s*1. An initial average level adjustment value Nave of when the high frequency power supply device performs an output power level adjusting process for the first time can be obtained, e.g., as an average value of the previous level adjustment values N. However, the initial average level adjustment value Nave may be an arbitrary value. Even if it is so, as will be later described, the average level adjustment value Nave converges on a proper value while the process is repeated.

The correction factor B is determined by a characteristic of the plasma load 20. The correction factor B can be obtained by checking in advance the characteristic of the plasma load 20 that is a target to be supplied with power. The value of the correction factor B is changed at the elapsed times t1 to t6, as in the level adjustment signal 13*bs* shown in (c) of FIG. 2. The level adjustment signal 13*bs* shown in (c) of FIG. 2 is changed in conformity with the value of the correction factor B at the elapsed times t1 to t6. The fluctuations of the output power Pf of the high frequency power supply device shown in (a) of FIG. 2 can be suppressed by changing the correction factor B in conformity with the characteristic of the plasma load 20.

The control unit 16 corrects and outputs the level control signal 16*s*2 based on the correction factor B corresponding to the elapsed time t after the modulation signal 16*s*1 is turned on between the pulse-on states of the modulation signal 16*s*1. Specifically, the control unit 16 reads out the correction factor B corresponding to the elapsed time t and the average level adjustment value Nave from the storage unit 16*a* and calculates the level adjustment value N based on the correction factor B and the average level adjustment value Nave. For example, the control unit 16 calculates the level adjustment value N by multiplying the correction factor B by the average level adjustment value Nave. Further, the control unit 16 determines a control amount by the level control signal 16*s*2 to be outputted to the D/A converter 13*b* in conformity with a magnitude of the level adjustment value N. Furthermore, the control unit 16 obtains a value of the output power Pf from the output power detection unit 15, at each elapsed time t after the modulation signal 16*s*1 is turned on, and stores the obtained value in the storage unit 16*a*.

In the example of FIG. 2, the control unit 16 calculates the level adjustment value N in each of the elapsed time t1 to t6 based on the correction factors B1 to B6, which correspond to the elapsed times t1 to t6 after the modulation signal 16*s*1 is turned on, and the average level adjustment value Nave, and outputs the level control signal 16*s*2, i.e., the level adjustment signal 13*bs*. Further, the control unit 16 obtains values of the output powers Pf1 to Pf6 at the elapsed times t1 to t6 and stores the obtained values in the storage unit 16*a*.

When the modulation signal 16*s*1 is turned off, the control unit 16 calculates and updates the average level adjustment value Nave based on the obtained values of the output powers Pf1 to Pf6 and the set power value Ps. Specifically, when the modulation signal 16*s*1 is turned off, the control unit 16 obtains an average value Pfa of the output powers Pf1 to Pf6 and compares the average value Pfa with the set power value Ps. If a difference between the average value Pfa and the set power value Ps falls within a predetermined range, the control unit 16 waits for the next on-state of the modulation signal 16*s*1. When the modulation signal 16*s*1 is turned on, the above-described process in the on-state of the modulation signal 16*s*1 is identically repeated. If the difference between the average value Pfa and the set power value Ps does not fall within the predetermined range, the control unit 16 calculates and updates the average level adjustment value Nave based on the difference between the average value Pfa and the set power value Ps and stores the updated value in the storage unit 16*a*. Thereafter, the control unit 16 waits for the next on-state of the modulation signal 16*s*1, and when the modulation signal 16*s*1 is turned on, the control unit 16 identically repeats the above-described process in the on-state of the modulation signal 16*s*1.

For example, in a case where the difference between the average value Pfa and the set power value Ps does not fall within the predetermined range, if the average value Pfa is smaller than the set power value Ps, the control unit 16 updates the average level adjustment value Nave such that the average level adjustment value Nave increases by a predetermined value C1. If the average value Pfa is larger than the set power value Ps, the control unit 16 updates the average level adjustment value Nave such that the average level adjustment value Nave decreases by a predetermined value C2. Here, the values C1 and C2 may be the same to each other or different from each other.

As such, the control unit 16 sets, as a reference parameter, the elapsed time t from when the modulation signal 16*s*1 is turned on, and reads out the correction factor B, which is stored in association with the elapsed time t from a LUT (look-up table) including the storage unit 16*a* in the control unit 16. Further, the control unit 16 corrects the fluctuations of the output power Pf due to a change in impedance of the plasma load 20 in an on-period of the modulation signal 16*s*1 by multiplying the correction factor B by the average level adjustment value Nave. By doing so, the control unit 16 obtains a constant output power Pf in an on-state of the modulation signal 16*s*1.

An output power level adjusting method in accordance with the first embodiment will be described in detail with reference to a flow chart of FIG. 3. The adjustment of an output power level is controlled by the control unit 16. First, a set power value Ps and an allowable power range are set in an initial setting and stored in the storage unit 16*a* in step S1. The allowable power range is an allowable difference value between an output power Pf and the set power value Ps.

Next, the high frequency power supply device is operated and it is examined whether or not the modulation signal 16*s*1 is in an on state, i.e., whether or not the output power Pf has been outputted in step S2. If the modulation signal 16*s*1 is not in an on state (NO in step S2), the device waits until the modulation signal 16*s*1 is turned on. If the modulation signal 16*s*1 is turned on (YES in step S2), a correction factor B corresponding to the elapsed time t after the modulation signal 16*s*1 is turned on is read out from the storage unit 16*a* in step S3. As described above, the correction factor B is a factor for correcting a value of the output power Pf that varies depending on the elapsed time t after the modulation signal 16*s*1 is turned on. At an elapsed time t1 that is an initial detection point, the correction factor B1 corresponding to the elapsed time t1 is read out.

Further, the average level adjustment value Nave is read out from the storage unit 16*a*, and the level adjustment value N at the elapsed time t1 is calculated based on the read average level adjustment value Nave and the correction factor B1 in step S4. The level adjustment value N is updated in step S5. By updating the level adjustment value N, the level control signal 16*s*2 is updated. A value pf1 of the output power Pf at the elapsed time t1 is obtained in step S6.

Thereafter, it is examined whether or not the modulation signal 16*s*1 is in an off state, i.e., whether or not the output power Pf has been turned off in step S7. If the modulation signal 16*s*1 is not in an off-state (NO in step S7), t is set to t(1+1) in step S8, i.e., an elapsed time t2 is set as a next detection point, and then the flow returns to step S3 to perform at the elapsed time t2 the same process as in the elapsed time t1.

If the modulation signal 16*s*1 is in an off-state (YES in step S7), an average value Pfa of the obtained output power Pf (Pf1 to Pf6 in the example of FIG. 2) is calculated in step S9 and the output power average value Pfa and the set power value Ps are compared to each other in step S10.

If a difference between the output power average value Pfa and the set power value Ps does not fall within the allowable power range (NO in step S11), the average level adjustment value Nave is calculated and updated based on the difference between the output power average value Pfa and the set power value Ps in step S12. The elapsed time t is cleared in step S13 and then the flow returns to step S2.

For example, in a case where the difference between the output power average value Pfa and the set power value Ps is not within the allowable power range, if the output power average value Pfa is smaller than the set power value Ps, the average level adjustment value Nave is calculated to increase by a predetermined value C1. Further, if the output power average value Pfa is larger than the set power value Ps, the average level adjustment value Nave is calculated to decrease by a predetermined value C2 and the average level adjustment value Nave is updated. Here, the values C1 and C2 may be the same to each other or different from each other.

If the difference between the output power average value Pfa and the set power value Ps falls within the allowable power range (YES in step S11), the elapsed time t is cleared in step S13 and the flow returns to step S2.

In the first embodiment, the output power Pf is obtained in the whole on-period of the modulation signal 16*s*1 (t1 to t6 in the example of FIG. 2), and the average level adjustment value Nave is calculated based on the obtained output power Pf. However, the average level adjustment value Nave may be calculated based on the output power Pf obtained in a part of the on-period of the modulation signal 16*s*1. Further, in the first embodiment, a plurality of the elapsed times is provided at 6 points but is not limited to 6 points.

In accordance with the first embodiment, at least the following effects (A1) to (A3) can be acquired. (A1) When a plurality of elapsed times passes in an on-state of the pulsed high frequency signal, a level of the pulsed high frequency signal is adjusted based on the correction factor corresponding to each of the elapsed times, so that an output power value can be corrected during the on-state of the pulsed high frequency signal. Therefore, in the on-state of the pulsed high frequency signal, even in a case where impedance is changed due to a change in a state of the plasma load, the fluctuations of the output power level in the on-state can be controlled. (A2) When a plurality of elapsed times passes in an on-state of the pulsed high frequency signal, a level of the pulsed high frequency signal is adjusted based on the correction factor corresponding to each of the elapsed times and the average level adjustment value, and output power values are obtained. Further, if a difference between the set power value and each of the output power values is not within a predetermined range in an off-state of the pulsed high frequency signal, the average level adjustment value is updated. Therefore, even though the average level adjustment value has been set to an arbitrary value, the average level adjustment value can converge on a proper value by repeating the output power level adjusting process. (A3) When the output power value is larger than the set power value by a predetermined value or more, the average level adjustment value is made smaller, and when the output power value is smaller than the set power value by the predetermined value or more, the average level adjustment value is made larger. Therefore, the output power value can be made to be within a range not exceeding the predetermined value from the set power value.

Second Embodiment

Next, a second embodiment of the present invention will be described. A functional configuration of a high frequency power supply device in the second embodiment is equal to that in the first embodiment, except a configuration of the control unit 16. In the second embodiment, the control unit 16 operates to frequently update the correction factor B. Specifically, the control unit 16 compares the set power value Ps and the output power Pf at each elapsed time t in a pulse-on state (on-state of the modulation signal 16*s*1), and updates the correction factor B such that a difference Pd between the set power value Ps and the output power Pf becomes smaller than a difference Pd' in a previous pulse-on state at each elapsed time t.

Figure 4A:
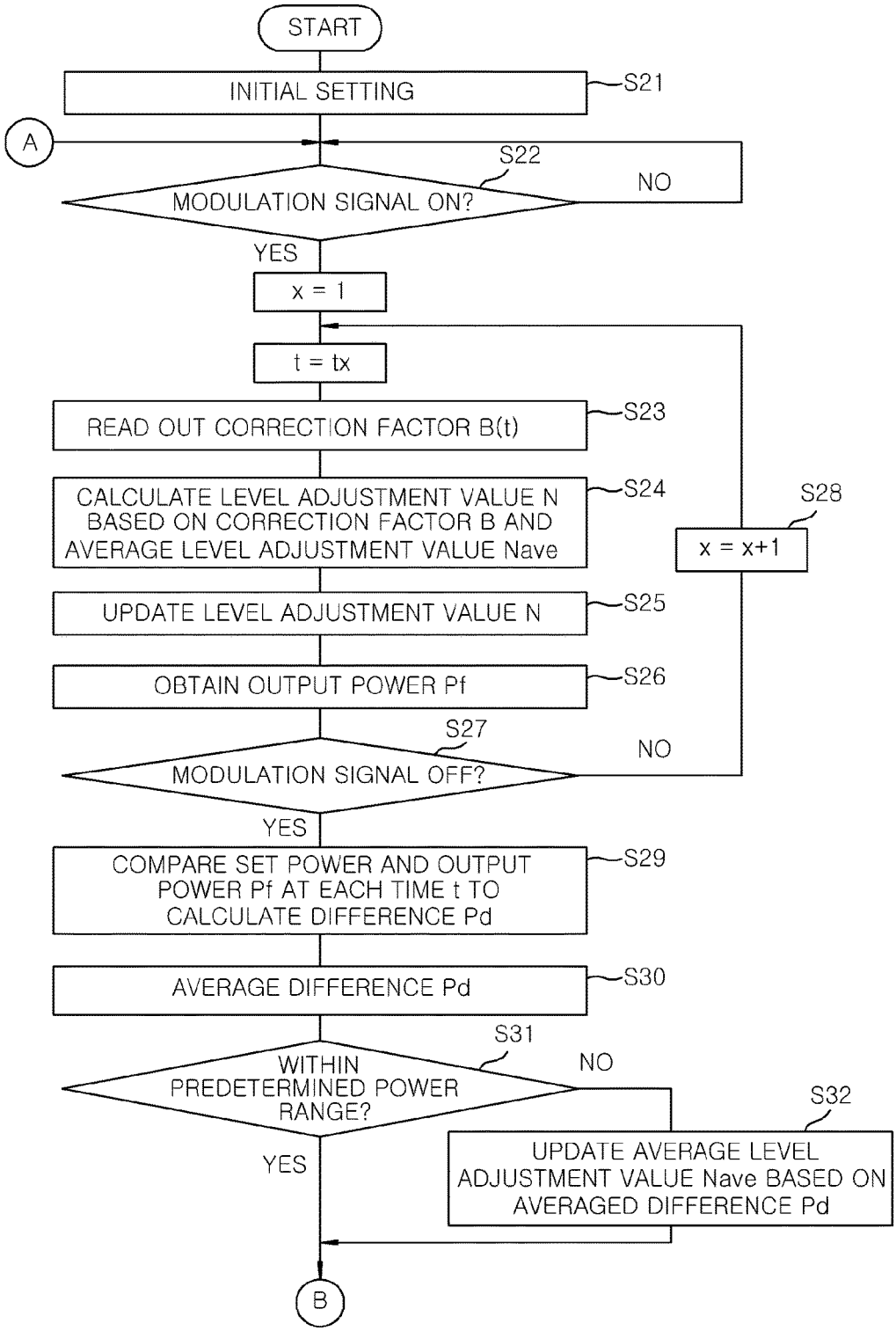
FIGS. 4A and 4B are a flow chart showing an output power level adjusting method in accordance with a second embodiment of the present invention.
Figure 4B:
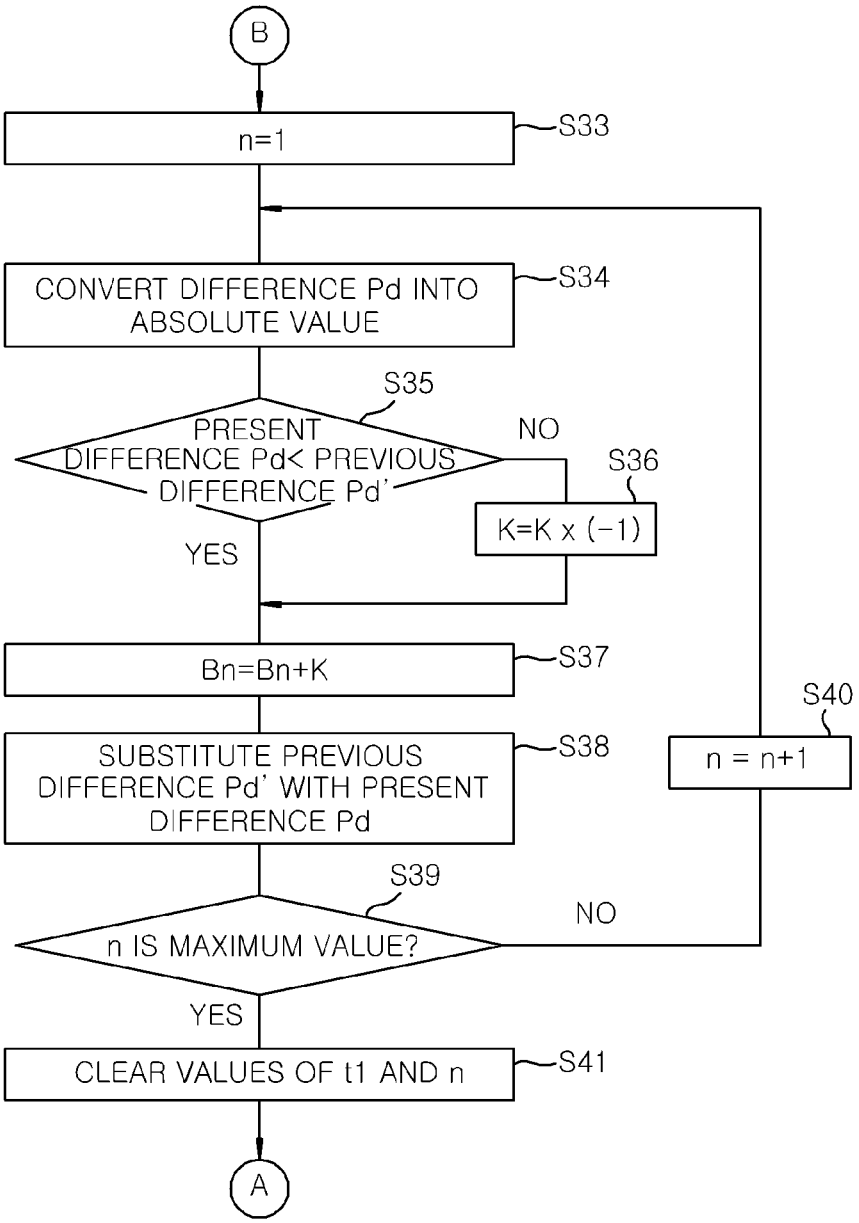
Figure 5:
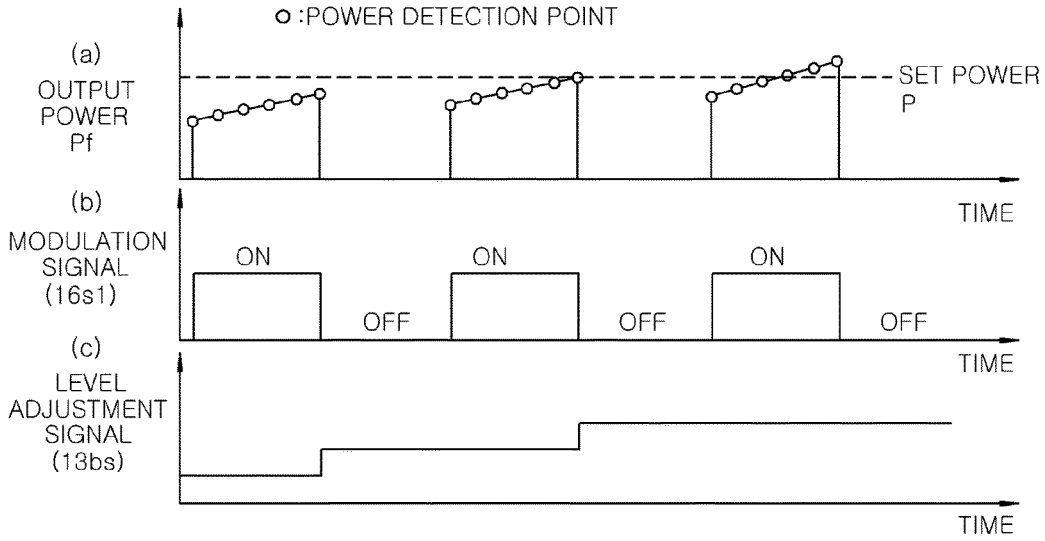
FIG. 5 (RELATED ART)
FIG. 5 is a schematic view showing signal waveforms of a conventional high frequency power supply device.
Figure 6:
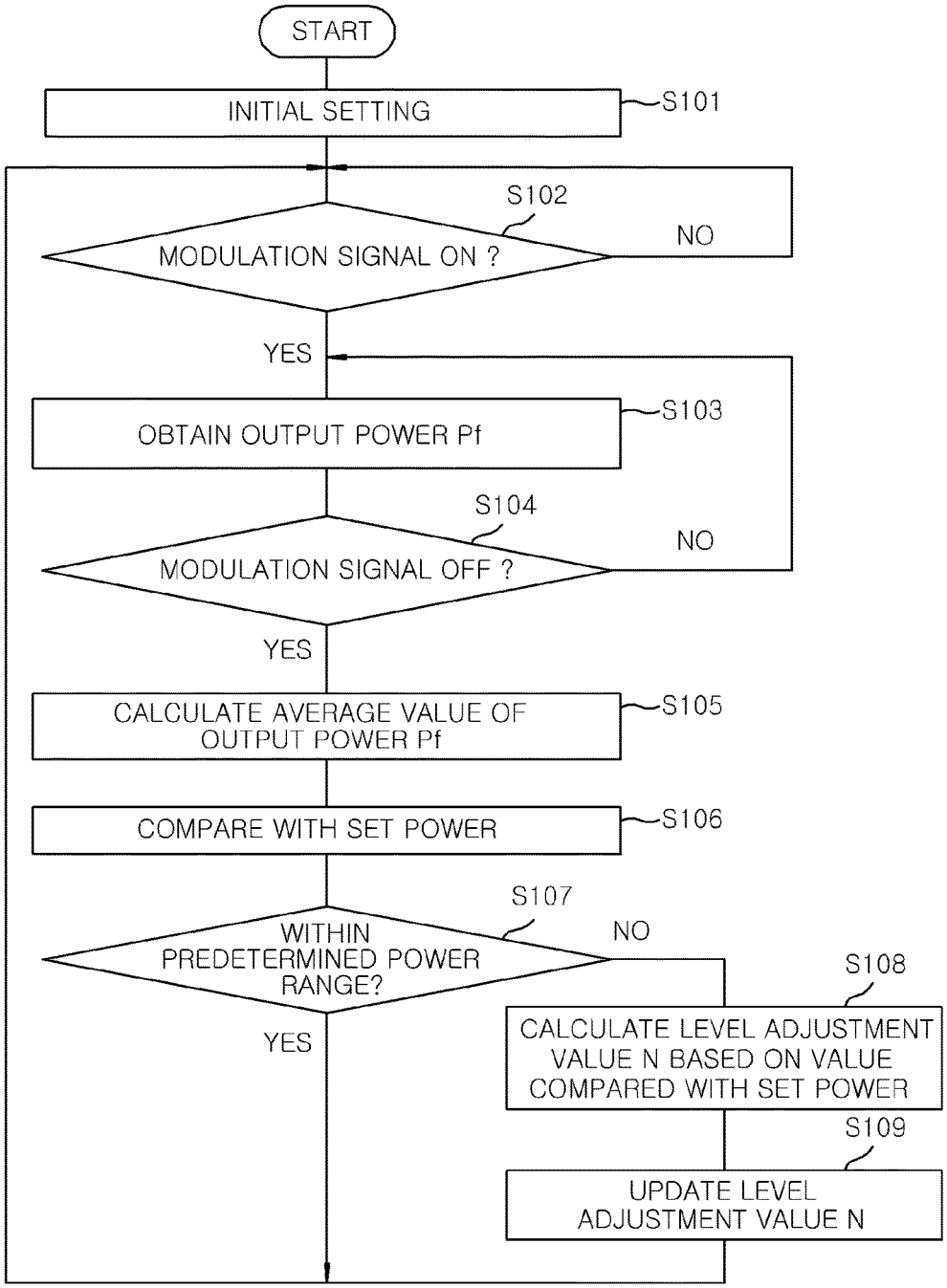
FIG. 6 (RELATED ART)
FIG. 6 is a flow chart showing a conventional output power level adjusting method.

An output power level adjusting method in accordance with the second embodiment will be described in detail with reference to a flow chart of FIGS. 4A and 4B. FIGS. 4A and 4B are a flow chart showing the output power level adjusting method in accordance with the second embodiment. The adjustment of an output power level is controlled by the control unit 16. First, a set power value Ps and an allowable power range are set in an initial setting in step S21. The allowable power range is an allowable difference value between an output power Pf and the set power value Ps.

Next, the high frequency power supply device is operated and it is examined whether or not the modulation signal 16*s*1 is in an on state, i.e., whether or not the output power Pf has been outputted in step S22. If the modulation signal 16*s*1 is not in an on state (NO in step S22), the device waits until the modulation signal 16*s*1 is turned on. If the modulation signal 16*s*1 is turned on (YES in step S22), the correction factor B corresponding to the elapsed time t after the modulation signal 16*s*1 is turned on is read out from the storage unit 16*a* in step S23. At an elapsed time t1 that is an initial detection point, a correction factor B1 corresponding to an elapsed time t1 is read out.

Further, the average level adjustment value Nave is read out from the storage unit 16*a*, and the level adjustment value N is calculated based on the read average level adjustment value Nave and the correction factor B1 in step S24. The level adjustment value N is updated in step S25. By updating the level adjustment value N, the level control signal 16*s*2 is updated. A value pf1 of the output power Pf at the elapsed time t1 is obtained in step S26.

Thereafter, it is examined whether or not the modulation signal 16*s*1 is in an off state, i.e., whether or not the output power Pf has been turned off in step S27. If the modulation signal 16*s*1 is not in an off-state (NO in step S27), t is set to t(1+1) in step S28, i.e., an elapsed time t2 is set as a next detection point, and then the flow returns to step S23 to read out a correction factor B2 from the storage unit 16*a* at the elapsed time t2. Subsequently, the same process as in the elapsed time t1 is performed. In this example, at the elapsed times t1 to t6, the correction factors B1 to B6 are respectively read out from the storage unit 16*a* and the same process as in the elapsed time t1 is performed.

If the modulation signal 16*s*1 is in an off-state (YES in step S27), the set power value Ps and the output power Pf (Pf1 to Pf6) obtained at each of the elapsed times t1 to t6 are compared with each other to calculate the difference Pd (Pd1 to Pd6) therebetween in step S29. The difference Pd is averaged in step S30. If an average value Pda of the difference Pd does not fall within a predetermined allowable power range (NO in step S31), the average level adjustment value Nave is calculated and updated based on a difference between the average value Pda and the set power value Ps in step S32.

For example, in a case where the average value Pda of the difference Pd is not within the predetermined allowable power range, if the average value Pda is larger than the set power value Ps, the average level adjustment value Nave is calculated to decrease by a predetermined value C21. Further, if the average value Pda is smaller than the set power value Ps, the average level adjustment value Nave is calculated to increase by a predetermined value C22 and the average level adjustment value Nave is updated. By updating the average level adjustment value Nave, a magnitude of the level adjustment signal 13*bs* outputted to the level adjustment circuit 13*a* is updated. Here, the values C21 and C22 may be the same to each other or different from each other.

If the average value Pda falls within the predetermined allowable power range (YES in step S31), the flow goes to step S33.

In the above process (steps S21 to S32), as in the first embodiment, the level adjustment value N is updated based on the correction factor B and the average level adjustment value Nave, and the average level adjustment value Nave is updated based on the set power value Ps and the output power Pf at each elapsed time t. In the second embodiment, the correction factor B (B1 to B6) is also updated at each elapsed time t (t1 to t6) in a subsequent process after step S33 which will be described below.

First, a variable n is initialized, i.e., n is set to 1 in step S33. Next, the difference Pd (Pd1 to Pd6) between the set power value Ps and the output power Pf (Pf1 to Pf6) at each elapsed time t is converted into an absolute value in step S34.

In a case where the output power Pf1 is larger than the set power value Ps, if a difference Pd1 (absolute value) at the elapsed time t1 in a current pulse-on state is equal to or larger than a difference Pd1' (absolute value) at the elapsed time t1 in a previous pulse-on state (NO in step S35), the polarity of an updating value K of step S37 for updating the correction factor B1 at the elapsed time t1 is reversed in step S36. This is because the current correction factor B1 is considered to have become bigger than a previous correction factor B1 (i.e., the plus polarity of the updating value K). In this way, the polarity of the updating value K is converted to minus and the correction factor B1 is made to decrease by the predetermined value K in step S37. As such, the correction factor B1 at the elapsed time t1 is changed and updated such that a difference Pd1" (absolute value) at the elapsed time t1 in a subsequent pulse-on state becomes smaller than the difference Pd1 (absolute value) in the current pulse-on state.

Further, in the case where the output power Pf1 is larger than the set power value Ps, if the difference Pd1 (absolute value) at the elapsed time t1 in the current pulse-on state is smaller than the difference Pd1' (absolute value) in the previous pulse-on state (YES in step S35), the correction factor B1 is changed and updated without reversing the polarity of the updating value K of step S37 for updating the correction factor B1 at the elapsed time t1. This is because the current correction factor B1 is considered to have become smaller than the previous correction factor B1 (i.e., the minus polarity of the updating value K). In this way, the correction factor B1 is made to decrease by the predetermined value K in step S37. As such, the correction factor B1 at the elapsed time t1 is changed and updated such that the difference Pd1" (absolute value) at the elapsed time t1 in the subsequent pulse-on state becomes smaller than the difference Pd1 (absolute value) in the current pulse-on state.

On the other hand, in a case where the output power Pf1 is smaller than the set power value Ps, if the difference Pd1 (absolute value) at the elapsed time t1 in the current pulse-on state is equal to or larger than the difference Pd1' (absolute value) at the elapsed time t1 in the previous pulse-on state (NO in step S35), the polarity of the updating value K of step S37 for updating the correction factor B1 at the elapsed time t1 is reversed in step S36. This is because the current correction factor B1 is considered to have become smaller than the previous correction factor B1 (i.e., the minus polarity of the updating value K). In this way, the polarity of the updating value K is converted to plus and the correction factor B1 is made to increase by the predetermined value K in step S37. As such, the correction factor B1 at the elapsed time t1 is changed and updated such that the difference Pd1"

(absolute value) at the elapsed time t1 in the subsequent pulse-on state becomes smaller than the difference Pd1 (absolute value) in the current pulse-on state.

Further, in the case where the output power Pf1 is smaller than the set power value Ps, if the difference Pd1 (absolute value) at the elapsed time t1 in the current pulse-on state is smaller than the difference Pd1' (absolute value) in the previous pulse-on state (YES in step S35), the correction factor B1 is changed and updated without reversing the polarity of the updating value K of step S37 for updating the correction factor B1 at the elapsed time t1. This is because the current correction factor B1 is considered to have become larger than a previous correction factor B1 (i.e., the plus polarity of the updating value K). In this way, the correction factor B1 is made to increase by the predetermined value K in step S37. As such, the correction factor B1 at the elapsed time t1 is changed and updated such that the difference Pd1" (absolute value) at the elapsed time t1 in the subsequent pulse-on state becomes smaller than the difference Pd1 (absolute value) in the current pulse-on state.

As described above, in the case where the output power Pf1 is larger than the set power value Ps, the corresponding correction factor B is made to decrease, and in the case where the output power Pf1 is smaller than the set power value Ps, the corresponding correction factor B is made to increase. Accordingly, the correction factor B can converge on a proper value.

Thereafter, in step S38, the difference Pd1' in the previous pulse-on state is substituted with the difference Pd1 in the current pulse-on state. In other words, in the subsequent pulse-on state, the difference Pd1 in the current pulse-on state at the elapsed time t1 is treated as the difference Pd1' in the previous pulse-on state. The difference Pd1 in the current pulse-on state is stored in the storage unit 16*a*.

When the variable n is not a maximum value (6 in this example) of the number of the detection points (NO in step S39), 1 is added to n in step S40, i.e., n is set to 2. Subsequently, as in the case of the correction factor B1, a process of updating a correction factor B2 at an elapsed time t2 is performed and a difference Pd2' in a previous pulse-on state at the elapsed time t2 is substituted with a difference Pd2 in a current pulse-on state. The difference Pd2 is stored in the storage unit 16*a*.

When the variable n is the maximum value (6 in this example) of the number of the detection points, the elapsed time t and the variable n are cleared in step S41 and the flow returns to step S22.

As described above, in the second embodiment, the correction factors B corresponding to the elapsed time t are updated such that the difference between the set power value Ps and the output power Pf becomes smaller by repeating the above-described process at each elapsed time t.

In the second embodiment, the output power Pf is obtained at each elapsed time t, and the difference Pd between the output power Pf and the set power value Ps is calculated, and the average level adjustment value Nave is updated based on the average value Pda of the difference Pd. However, as in the first embodiment, the average value Pfa of the output power Pf may be calculated and the average level adjustment value Nave may be updated based on the average value Pfa and the set power value Ps. on the contrary, in the first embodiment, as in the second embodiment, the difference Pd between the output power Pf and the set power value Ps may be calculated, and the average level adjustment value Nave may be updated based on the average value Pda of the difference Pd. Further, in the second embodiment, both of the average level adjustment value Nave and the correction factor B are updated, but only the correction factor B may be updated without updating the average level adjustment value Nave.

In accordance with the second embodiment, in addition to the effect of the first embodiment, at least the following effects (B1) to (B4) can be acquired. (B1) The correction factor is updated based on a first power value difference and a second power value difference, the first power value difference being a difference between an output power value detected when the pulsed high frequency signal is turned on and a set power value, and the second power value difference being a difference between an output power value detected when the pulsed high frequency signal is next turned on and the set power value. Therefore, the correction factor corresponding to each elapsed time can be set to a proper value in an on-state of the pulsed high frequency signal. (B2) In a case where the output power value is larger than the set power value, (a) if the second power value difference is larger than the first power value difference, the corresponding correction factor is made smaller. Therefore, when the pulsed high frequency signal is next turned on, the output power value can be decreased. Further, (b) if the second power value difference is smaller than the first power value difference, the corresponding correction factor is made smaller. Therefore, when the pulsed high frequency signal is next turned on, the output power value can be further decreased. (B3) In a case where the output power value is smaller than the set power value, (c) if the second power value difference is larger than the first power value difference, the corresponding correction factor is made larger. Therefore, when the pulsed high frequency signal is next turned on, the output power value can be increased. Further, (d) if the second power value difference is smaller than the first power value difference, the corresponding correction factor is made larger. Therefore, when the pulsed high frequency signal is next turned on, the output power value can be further increased. (B4) In the case where the output power value is larger than the set power value, the corresponding correction factor is made smaller, and in the case where the output power value is smaller than the set power value, the corresponding correction factor is made larger. Therefore, the correction factor can converge on a proper value.

Third Embodiment

A difference of a third embodiment from the first and second embodiments will be described. In the first and second embodiments, the correction factor B1 is read out from a table that is previously set. However, the correction factor B1 may be frequently updated. In the third embodiment, a comparison value in a current pulse and a comparison value in a previous pulse are compared with each other and the correction factor B1 is updated such that the comparison result between a set power P and the output power Pf becomes smaller at each reflection coefficient Γ. The control flow chart is only changed and a configuration of the device is the same as those in the first and second embodiments.

Figure 7A:
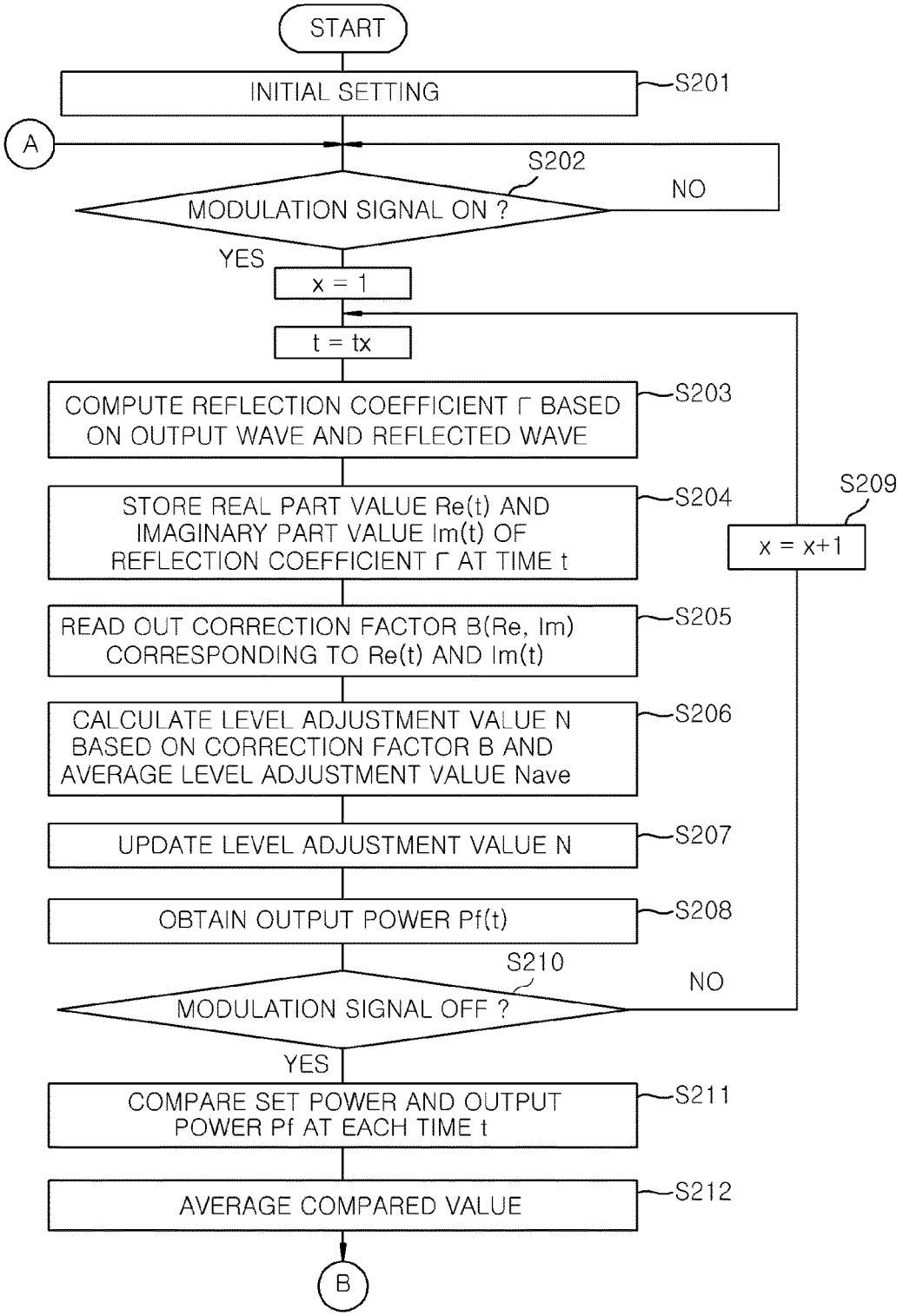
FIGS. 7A and 7B are a flow chart showing an output power level adjusting method in accordance with a third embodiment of the present invention.
Figure 7B:
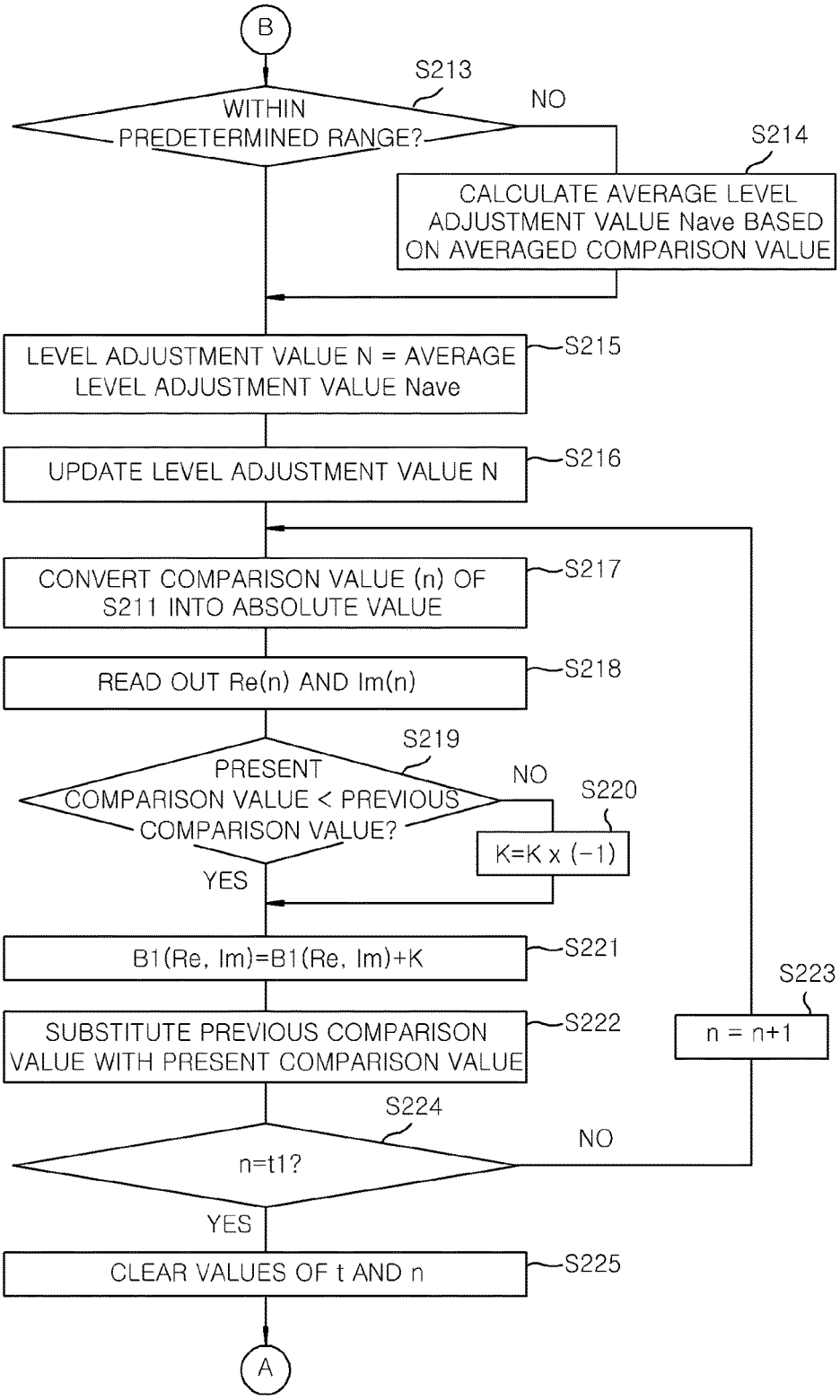

A flowchart of a control method in accordance with the third embodiment is shown in FIGS. 7A and 7B. First, in step S201, an initial setting is performed. A set power P and a power range are set in the initial setting. If the modulation signal is off in step S202, the process does not proceed. If modulation signal is on in step S202, a reflection coefficient Γ is computed based on an output wave voltage Vf and a reflected wave voltage Vr in step S203. In step S204, a real part value Re(t1) and an imaginary part value Im(t1) of the reflection coefficient Γ at time t1 are stored. In step S205, a correction factor B1 corresponding to the real part value Re(t1) and the imaginary part value Im(t1) of the reflection coefficient Γ is read out. The correction factor B1 is a factor for correcting the output power Pf that varies depending on the reflection coefficient. In step S206, the level adjustment value N is calculated based on the read correction factor B1 and the average level adjustment value Nave. In step S207, the level adjustment value N is updated. In step S208, a value of the output power Pf is obtained. If the modulation signal is on in step S210, t is set to t(1+1) in step S209, and the flow returns to step S203.

If the modulation signal is off in step S210, the set power and the output power Pf(t1) obtained at step S208 are compared with each other in step S211. An average value of the comparison result is computed in step S212. If the average value is not within a predetermined power range in step S213, the average level adjustment value Nave is calculated based on the result of step S212 in step S214. If the average value is within the predetermined power range in step S213, the level adjustment value N is substituted with the average level adjustment value Nave in step S215 and the level adjustment value N is updated in step S216. In step S217, a comparison value (n) of step S211 is converted into an absolute value. In step S218, Re(n) and Im(n) stored at step S204 are read out. If a comparison value in a current pulse is larger than a comparison value in a previous pulse in step S219, a polarity of K is reversed in step S220.

The symbol K is an updating value of when the correction factor B1 is updated. In a case where the current comparison value is larger than the previous comparison value, a polarity of the updating value K is reversed to update the correction factor B1 such that a comparison value in a subsequent pulse becomes smaller than the current comparison value. In step S221, the updating value K is added to the correction factor B1 corresponding to Re(n) and Im(n) read out at step S218. In step S222, the previous comparison value (n) is substituted with the current comparison value (n). If n is not equal to t1 in step S224, 1 is added to n in step S223, and the process from step S217 is performed again. If n is equal to t1 in step S224, values of t1 and n are cleared in step S225 and the flow returns to step S202.

By repeating the above process, the correction factor B1 is updated such that a difference between the set power P and the detected output power Pf becomes smaller. A further stable level control becomes possible by updating the correction factor B1 at each operation.

The present invention is not limited to the above embodiments and may be variously modified without departing from the scope of the invention.

In the description of the present disclosure, at least the following configurations are included. As for a first configuration, there is provided a power supply device for plasma generation using a pulse modulation system which supplies a pulsed high frequency power to a plasma generation unit for generating plasma provided outside, the power supply device including: an oscillation unit configured to output a high frequency signal of a predetermined frequency; a modulation unit configured to modulate the high frequency signal outputted from the oscillation unit to a pulse shape in which on and off states are repeated and output the modulated high frequency signal as a pulsed high frequency signal; a level adjustment unit configured to adjust a level of the pulsed high frequency signal outputted from the modulation unit and output the level-adjusted pulsed high frequency signal; a power amplifier configured to amplify a power of the pulsed high frequency signal outputted from the level adjustment unit and output a pulsed high frequency power; an output power detection unit configured to detect an output power value of the pulsed high frequency power outputted from the power amplifier; a storage unit that stores a plurality of elapsed times in an on-state of the pulsed high frequency signal outputted from the modulation unit, a plurality of correction factors respectively corresponding to the elapsed times, and a set power value that is previously set as a value of an output power; and a control unit configured to receive the output power value detected by the output power detection unit, and output to the level adjustment unit a level control signal for controlling the level of the pulsed high frequency signal adjusted in the level adjustment unit based on the received output power value and the set power value, wherein the control unit corrects and outputs the level control signal at each of the elapsed times based on the correction factors respectively corresponding to the elapsed times, and compares a comparison value in a current pulse with a comparison value in a previous pulse to update the correction factors such that the comparison result between the set power value and the output power value becomes smaller at each reflection coefficient.

As for a second configuration, in the power supply device for plasma generation having the first configuration, the storage unit further stores an average level adjustment value needed when the level adjustment unit adjusts the level of the pulsed high frequency signal, and at each of the elapsed times, the control unit corrects and outputs the level control signal based on the average level adjustment value the correction factors respectively corresponding to the elapsed times, obtains the output power value from the output power detection unit, and if the pulsed high frequency signal is turned off, updates the average level adjustment value, based on the obtained output power values and the set power value, in a case where a difference between the output power value and the set power value is not within a predetermined range.

As for a third configuration, in the power supply device for plasma generation having the second configuration, the control unit allows the average level adjustment value to decrease when the output power value is larger than the set power value by a predetermined value or more, and allows the average level adjustment value to increase when the output power value is smaller than the set power value by a predetermined value or more.

As for a fourth configuration, in the power supply device for plasma generation having the first to third configurations, the control unit obtains, as a first power value difference, a difference between the output power value detected by the output power detection unit and the set power value at each of the elapsed times and obtains, as a second power value difference, a difference between the output power value and the set power value at each of the elapsed times in a subsequent on-state of the pulsed high frequency signal, and updates the correction factors respectively corresponding to the elapsed times based on the first power value difference and the second power value difference at each of the elapsed times.

As for a fifth configuration, in the power supply device for plasma generation having the fourth configuration, the control unit allows a corresponding correction factor to decrease when the output power value is larger than the set power value, and allows a corresponding correction factor to increase when the output power value is smaller than the set power value.

As for a sixth configuration, in the power supply device for plasma generation having the fourth configuration, the control unit allows a corresponding correction factor to decrease when the output power value is larger than the set power value and the second power value difference is larger than the first power value difference.

As for a seventh configuration, in the power supply device for plasma generation having the sixth configuration, the control unit allows a corresponding correction factor to decrease when the output power value is larger than the set power value and the second power value difference is smaller than the first power value difference.

As for an eighth configuration, in the power supply device for plasma generation having the fourth configuration, the control unit allows a corresponding correction factor to increase when the output power value is smaller than the set power value and the second power value difference is larger than the first power value difference.

As for a ninth configuration, in the power supply device for plasma generation having the eighth configuration, the control unit allows a corresponding correction factor to increase when the output power value is smaller than the set power value and the second power value difference is smaller than the first power value difference.

As for a tenth configuration, there is provided a power supply device for plasma generation using a pulse modulation system which supplies a pulsed high frequency power to a plasma generation unit for generating plasma provided outside, the power supply device including: an oscillation unit configured to output a high frequency signal of a predetermined frequency; a modulation unit configured to modulate the high frequency signal outputted from the oscillation unit to a pulse shape in which on and off states are repeated and output the modulated high frequency signal as a pulsed high frequency signal; a level adjustment unit configured to adjust a level of the pulsed high frequency signal outputted from the modulation unit and output the level-adjusted pulsed high frequency signal; a power amplifier configured to amplify a power of the pulsed high frequency signal outputted from the level adjustment unit and output a pulsed high frequency power; an output power detection unit configured to detects an output power value of the pulsed high frequency power outputted from the power amplifier; a storage unit that stores a plurality of elapsed times in an on-state of the pulsed high frequency signal outputted from the modulation unit, a plurality of correction factors respectively corresponding to the elapsed times, and a set power value that is previously set as a value of an output power; and a control unit configured to receive the output power value detected by the output power detection unit, and output to the level adjustment unit a level control signal for controlling the level of the pulsed high frequency signal adjusted in the level adjustment unit based on the received output power value and the set power value, wherein the control unit corrects and outputs the level control signal at each of the elapsed times based on the correction factors respectively corresponding to the elapsed times, and obtains, as a first power value difference, a difference between the output power value detected by the output power detection unit and the set power value at each of the elapsed times and obtains, as a second power value difference, a difference between the output power value and the set power value at each of the elapsed times in a subsequent on-state of the pulsed high frequency signal, and updates the correction factors respectively corresponding to the elapsed times based on the first power value difference and the second power value difference at each of the elapsed times.

The present application claims priority based on Japanese Patent Application No. 2013-174891 filed on Aug. 26, 2013, the entire contents of which are incorporated herein by reference.

INDUSTRIAL APPLICABILITY

The present invention may be useful to a high frequency power supply device used for generating plasma, especially to a power supply device for plasma generation.

DESCRIPTION OF REFERENCE NUMERALS

11 oscillation unit
12 modulation unit
13 level adjustment unit
13*a* level adjustment circuit
13*b* D/A converter
14 power amplifier
15 output power detection unit
15*a* directional coupler
15*b* detector
15*c* A/D converter
16 control unit
16*a* storage unit
20 plasma load

What is claimed is:

1. A power supply device for plasma generation using a pulse modulation system which supplies a pulsed high frequency power to a plasma generation unit for generating plasma provided outside, the power supply device comprising:

an oscillation unit configured to output a high frequency signal of a predetermined frequency;

a modulation unit configured to modulate the high frequency signal outputted from the oscillation unit to a pulse shape in which on and off states are repeated and output the modulated high frequency signal as a pulsed high frequency signal;

a level adjustment unit configured to adjust a level of the pulsed high frequency signal outputted from the modulation unit and output the level-adjusted pulsed high frequency signal;

a power amplifier configured to amplify a power of the pulsed high frequency signal outputted from the level adjustment unit and output a pulsed high frequency power;

an output power detection unit configured to detect an output power value of the pulsed high frequency power outputted from the power amplifier;

a storage unit that stores a plurality of elapsed times in an on-state of the pulsed high frequency signal outputted from the modulation unit, a plurality of correction factors respectively corresponding to the elapsed times, and a set power value that is previously set as a value of an output power; and a control unit configured to receive the output power value detected by the output power detection unit, and output to the level adjustment unit a level control signal for controlling the level of the pulsed high frequency signal adjusted in the level adjustment unit based on the received output power value and the set power value, wherein the control unit is further configured to:

correct and output the level control signal at each of the elapsed times based on the correction factors respectively corresponding to the elapsed times;

obtain reflection coefficients each of which is computed based on an output wave voltage and a reflected wave voltage;

obtain comparison values each of which indicates a comparison result made between the set power value and the output power value at each of the elapsed times, the comparison values respectively corresponding to the reflection coefficients; and compare a comparison value in a current pulse with a comparison value in a previous pulse to update the correction factors such that a comparison value in a subsequent pulse becomes smaller than the comparison value in the current pulse.

2. The power supply device of claim 1, wherein the storage unit further stores an average level adjustment value needed when the level adjustment unit adjusts the level of the pulsed high frequency signal, and wherein, the control unit is further configured to:

at each of the elapsed times, correct and output the level control signal based on the average level adjustment value and the correction factors respectively corresponding to the elapsed times, and obtain the output power value from the output power detection unit; and if the pulsed high frequency signal is turned off, update the average level adjustment value, based on the obtained output power values and the set power value, in a case where a difference between the output power value and the set power value is not within a predetermined range.

3. The power supply device of claim 2, wherein the control unit is further configured to:

allow the average level adjustment value to decrease when the output power value is larger than the set power value by a predetermined value or more; and allow the average level adjustment value to increase when the output power value is smaller than the set power value by a predetermined value or more.

4. The power supply device of claim 1, wherein the control unit is configured to:

obtain, as a first power value difference, a difference between the output power value detected by the output power detection unit and the set power value at each of the elapsed times;

obtain, as a second power value difference, a difference between the output power value and the set power value at each of the elapsed times in a subsequent on-state of the pulsed high frequency signal; and update the correction factors respectively corresponding to the elapsed times based on the first power value difference and the second power value difference at each of the elapsed times.

5. A power supply device for plasma generation using a pulse modulation system which supplies a pulsed high frequency power to a plasma generation unit for generating plasma provided at outside, the power supply device comprising:

an oscillation unit configured to output a high frequency signal of a predetermined frequency;

a modulation unit configured to modulate the high frequency signal outputted from the oscillation unit to a pulse shape in which on and off states are repeated and output the modulated high frequency signal as a pulsed high frequency signal;

a level adjustment unit configured to adjust a level of the pulsed high frequency signal outputted from the modulation unit and output the level-adjusted pulsed high frequency signal;

a power amplifier configured to amplify a power of the pulsed high frequency signal outputted from the level adjustment unit and output a pulsed high frequency power;

an output power detection unit configured to detects an output power value of the pulsed high frequency power outputted from the power amplifier;

a storage unit that stores a plurality of elapsed times in an on-state of the pulsed high frequency signal outputted from the modulation unit, a plurality of correction factors respectively corresponding to the elapsed times, and a set power value that is previously set as a value of an output power; and a control unit configured to receive the output power value detected by the output power detection unit, and output to the level adjustment unit a level control signal for controlling the level of the pulsed high frequency signal adjusted in the level adjustment unit based on the received output power value and the set power value, wherein the control unit is further configured to:

correct and output the level control signal at each of the elapsed times based on the correction factors respectively corresponding to the elapsed times;

obtain, as a first power value difference, a difference between the output power value detected by the output power detection unit and the set power value at each of the elapsed times and obtains;

obtain, as a second power value difference, a difference between the output power value and the set power value at each of the elapsed times in a subsequent on-state of the pulsed high frequency signal; and update the correction factors respectively corresponding to the elapsed times based on the first power value difference and the second power value difference at each of the elapsed times.

6. A power supply method for plasma generation using a pulse modulation system which supplies a pulsed high frequency power to a plasma generation unit for generating plasma provided outside, the power supply method comprising:

outputting a high frequency signal of a predetermined frequency;

modulating the outputted high frequency signal to a pulse shape in which on and off states are repeated and outputting the modulated high frequency signal as a pulsed high frequency signal;

adjusting a level of the pulsed high frequency signal and outputting the level-adjusted pulsed high frequency signal;

amplifying a power of the pulsed high frequency signal and outputting a pulsed high frequency power;

detecting an output power value of the pulsed high frequency power; and allowing a control unit to receive the detected output power value and output to a level adjustment unit a level control signal for controlling the level of the pulsed high frequency signal adjusted in the level adjustment unit based on the received output power value and a set power value that is previously set as a value of an output power, wherein the control unit:

corrects and outputs the level control signal at each of a plurality of elapsed times in an on-state of the pulsed high frequency signal based on correction factors respectively corresponding to the elapsed times;

obtains reflection coefficients each of which is computed based on an output wave voltage and a reflected wave voltage;

obtains comparison values each of which indicates a comparison result made between the set power value and the output power value at each of the elapsed times, the comparison values respectively corresponding to the reflection coefficients; and compares a comparison value in a current pulse with a comparison value in a previous pulse to update the correction factors such that a comparison result value in a subsequent pulse becomes smaller than the comparison value in the current pulse.

7. The power supply method of claim 6, wherein:

at each of the elapsed times, the control unit corrects and outputs the level control signal based on an average level adjustment value needed when adjusting the level of the pulsed high frequency signal and the correction factors respectively corresponding to the elapsed times, obtains the output power value; and if the pulsed high frequency signal is turned off, the control unit updates the average level adjustment value, based on the obtained output power values and the set power value, in a case where a difference between the output power value and the set power value is not within a predetermined range.

8. The power supply method of claim 7, wherein the control unit allows the average level adjustment value to decrease when the output power value is larger than the set power value by a predetermined value or more, and allows the average level adjustment value to increase when the output power value is smaller than the set power value by a predetermined value or more.

9. The power supply method of claim 6, wherein the control unit obtains, as a first power value difference, a difference between the detected output power value and the set power value at each of the elapsed times and obtains, as a second power value difference, a difference between the output power value and the set power value at each of the elapsed times in a subsequent on-state of the pulsed high frequency signal, and updates the correction factors respectively corresponding to the elapsed times based on the first power value difference and the second power value difference at each of the elapsed times.

* * * * *